US005788158A

United States Patent [19]

Relyea

[11] Patent Number: 5,788,158

[45] Date of Patent: Aug. 4, 1998

[54] AUTOMATIC LEVELLING FLUID NOZZLE FOR AERIAL BOOM

[75] Inventor: Robert G. Relyea, Dallas, Tex.

[73] Assignee: Crash Rescue Equipment Service, Inc., Dallas, Tex.

[21] Appl. No.: 690,134

[22] Filed: Jul. 31, 1996

[51] Int. Cl.[6] ..... B05B 1/20

[52] U.S. Cl. ..... 239/166; 169/24

[58] Field of Search ..... 239/73, 160, 164–166, 239/170–172; 169/24, 25; 182/2.1, 2.2, 2.9, 2.11; 212/238, 255, 256, 261

[56] References Cited

U.S. PATENT DOCUMENTS

| | | | |
|---|---|---|---|
| 1,835,132 | 12/1931 | Anania | 182/2.2 X |
| 3,010,533 | 11/1961 | Ross | 169/25 X |
| 3,590,948 | 7/1971 | Milner, Jr. | 182/2.1 |
| 4,103,757 | 8/1978 | McVaugh | 182/2.1 |
| 4,160,492 | 7/1979 | Johnston | 182/2.11 X |
| 4,456,093 | 6/1984 | Finley et al. | 182/2.1 |
| 5,021,917 | 6/1991 | Pike et al. | 182/2.11 X |
| 5,211,245 | 5/1993 | Relyea et al. | 169/24 |
| 5,301,756 | 4/1994 | Relyea et al. | 169/24 |

*Primary Examiner*—Andres Kashnikow
*Assistant Examiner*—Steven J. Ganey
*Attorney, Agent, or Firm*—Jones, Day, Reavis & Pogue

[57] ABSTRACT

An automatic levelling device for a fluid nozzle pivotally mounted on the outer end of an aerial boom such that, irrespective of the vertical position of the boom, the nozzle will remain in a horizontal plane. Either manually operated control of the fluid nozzle vertical position or automatic control that maintains the fluid nozzle in a horizontal plane can be selected by a switch.

5 Claims, 4 Drawing Sheets

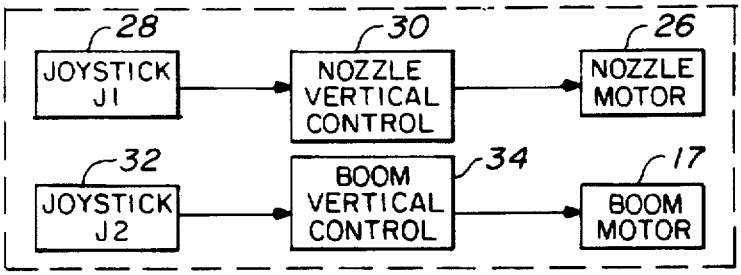
FIG. 2
PRIOR ART
FIG. 4
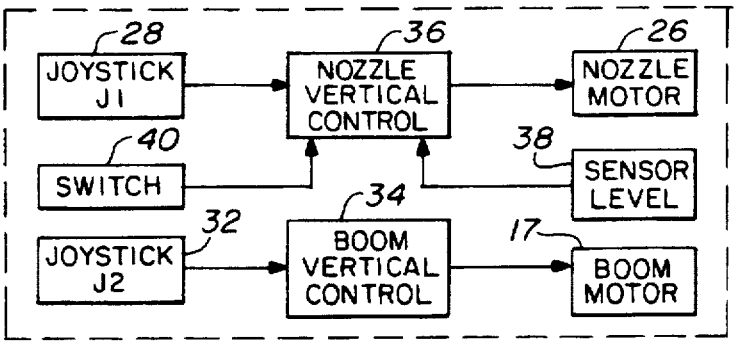
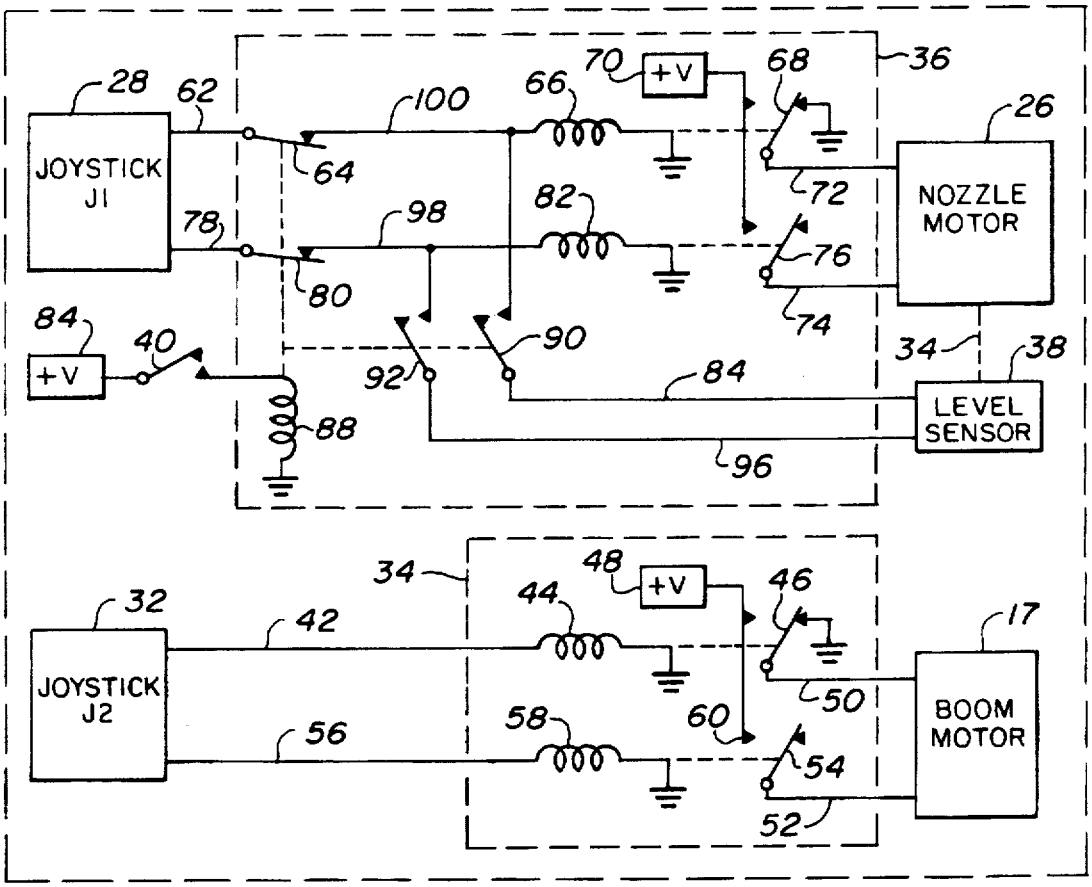
FIG. 5

AUTOMATIC LEVELLING FLUID NOZZLE FOR AERIAL BOOM

BACKGROUND OF THE INVENTION

1. Field of the Invention

The present invention relates to vehicle aerial lifts in general and in particular to an aerial lift that has a boom movable in a vertical plane and a fluid nozzle pivotally mounted on the outer end of the boom for movement in the vertical plane and that can be automatically maintained in a horizontal plane at any given vertical position of the aerial boom.

2. Description of Related Art

In U.S. Pat. No. 5,211,245, incorporated herein by reference in its entirety, there is disclosed an aerial lift for use with a vehicle for positioning a fluid nozzle on the outer end of an upper boom that is coupled at its inner end to the outer end of a lower boom. The lower boom can be selectively raised and lowered in a plane from and above the horizontal and rotated about a vertical axis. The upper boom is independently articulated about its inner end with respect to the lower boom such that upper boom is selectively movable above and below the horizontal plane.

The advantage of the aerial lift disclosed therein is that the assembly has an upper boom that can be tilted or pivoted toward the ground as well as being pivotable upwardly. Further, it has the nozzle assembly on the outer end of the upper boom which can be pivoted both in the vertical plane and rotated in a plane perpendicular to the vertical plane. Thus with the invention disclosed in U.S. Pat. No. 5,211,245, an operator of a vehicle having the aerial lift thereon can drive towards the fire and position the boom and novel nozzle in any position advantageous to ejecting fire-fighting chemicals on the blaze. In the vehicle, there is a control console that has a first joystick for positioning the boom in a vertical plane and a second joystick for positioning the nozzle in both the vertical plane and the horizontal plane.

When the vehicle is approaching a fire, the operator is extremely busy controlling the position of the vehicle, operating radios, operating pumping controls, positioning the boom and the nozzle, and other activities necessary during the crucial early stages of fighting the fire. In particular this is a difficult situation when fighting aircraft fires because every second is extremely important. As the vehicle begins to spray the fire retardant material towards the aircraft fire as the vehicle approaches, the boom may be moving through any particular vertical position and the nozzle likewise may be in any particular position in the vertical plane. This means that the fire retardant material being ejected by the fluid nozzle may not be striking the fire until the operator can position not only the boom in the vertical plane at the right height but also position the nozzle in the vertical plane at the proper height.

It would be advantageous to simplify the operations if the fluid nozzle could be maintained in a horizontal plane automatically while the vertical position of the boom is being controlled with only one joystick or other type controller. This would greatly simplify the operations by removing the necessity of controlling the fluid nozzle with another joystick or controller. It would still allow the fluid to be directed towards the fire while the boom is being positioned in a vertical plane at the proper height.

When combined with automated boom positioning systems, well known in the art, the nozzle would automatically maintain a level, or horizontal, forward reaching water/foam stream of fire retardant material as boom positions are selected during a roll-in approach to the fire.

SUMMARY OF THE INVENTION

The present invention includes an automatic levelling sensor associated with the fluid nozzle movement in the vertical plane. The sensor generates first and second output signals representing positions above and below the horizontal plane. When the boom is moving so as to cause the fluid nozzle to be moving out of the horizontal plane, the sensor generates signals that are coupled to the drive motor that drives the fluid nozzle in the vertical plane to maintain its horizontal position.

The drive motor for the fluid nozzle can be driven manually with the operator-controlled joystick or automatically by the level sensor simply by placing a switch in one of first and second positions. When in the first position, the control of the vertical position of the nozzle is manual and accomplished with a joystick control and, in the second position, the control of the vertical position of the fluid nozzle is automatic with the sensor maintaining the fluid nozzle in the horizontal plane irrespective of the position of the boom in the vertical plane.

Thus it is an object of the present invention to provide an improved fire-fighting system by automatically maintaining a fluid nozzle in the horizontal plane when pivotally coupled to the outer end of an aerial boom that moves in a vertical plane.

It is another object of the present invention to allow either manual control of the fluid nozzle in the vertical plane or automatic control to cause it to remain in the horizontal plane regardless of the vertical position of the boom to which it is pivotally attached.

Thus the present invention relates to apparatus for automatically maintaining a fluid nozzle in the horizontal plane when pivotally coupled to the outer end of an aerial boom that moves in a vertical plane, the apparatus including an automatic level sensor associated with the fluid nozzle movement in the vertical plane, the sensor generating first and second output signals representing positions of the fluid nozzle above and below the horizontal plane, and a drive motor coupled to the fluid nozzle and to the automatic level sensor for receiving the first and second output signals and maintaining the fluid nozzle in the horizontal plane corresponding to the received signals.

BRIEF DESCRIPTION OF THE DRAWINGS

These and other features of the present invention will be more fully disclosed when taken in conjunction with the following DETAILED DESCRIPTION OF THE DRAWINGS in which like numerals represent like elements and in which:

FIG. 2 is a schematic representation of the prior art joystick controls for operating the boom and the nozzle in the vertical plane;

FIG. 4 is a schematic representation of the control circuits for the present invention utilizing the automatic levelling feature;

FIG. 5 is a detailed electrical schematic of the control circuits for the present invention to obtain automatic levelling of the fluid nozzle.

DETAILED DESCRIPTION OF THE DRAWINGS

Figure 1:
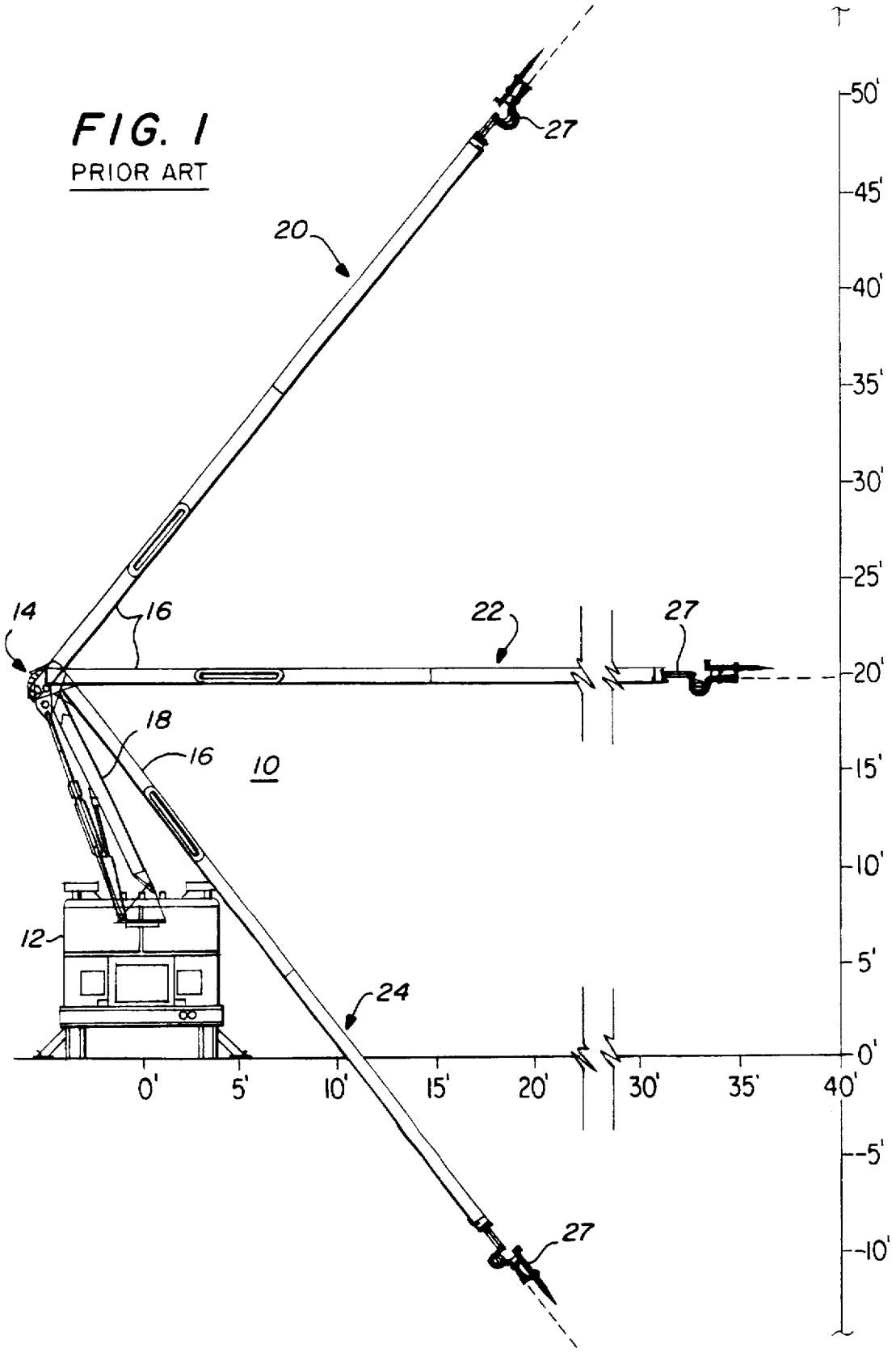
FIG. 1 PRIOR ART
FIG. 1 is a schematic representation of the prior art aerial boom with a fluid nozzle pivotally attached to the outer end thereof.

As shown in FIG. 1, the prior art fire-fighting system 10 includes a vehicle 12 having mounted thereon an aerial boom system 14 comprising an upper beam 16 pivotally connected to a lower beam 18 that is both rotationally and pivotally connected to the vehicle 12. The connections and operation thereof are well known as disclosed in commonly assigned U.S. Pat. No. 5,211,245. As can be seen in FIG. 1, at any of the vertical positions 20, 22, or 24 of the upper boom 16, the fluid nozzle 27 is maintained in longitudinal alignment with the upper boom 16 as the upper boom is moved to the vertical plane. To move the fluid nozzle 27 in the vertical plane with respect to the upper boom 16, a separate control is provided in the vehicle 12 such that the operator can move both the upper boom 16 and the fluid nozzle 27 in the vertical plane. This requires a circuit such as shown schematically in FIG. 2. There it can be seen that a first joystick 28 (or other type controller) generates signals to a control circuit 30 that causes a powered mechanism of any well-known type such as a motor 26 to drive the nozzle 27 in the vertical plane. It is to be understood, of course, that the joystick can also move the nozzle in the horizontal plane as disclosed in the prior art. However, the present invention is concerned only with the position of the nozzle in the vertical plane.

Also, in the vehicle 12 in FIG. 1 is a second joystick or control device 32 (shown in FIG. 2) that generates output signals to a control circuit 34 that drives a powered mechanism of any well-known type such as a hydraulic cylinder or a motor 17 to cause the boom 16 to move in a vertical plane. Thus it requires an operator moving both joysticks 28 and 32 to properly position the boom 16 and the nozzle 27 on the outer end thereof to correctly discharge the fire retardant in the proper direction.

Figure 3:
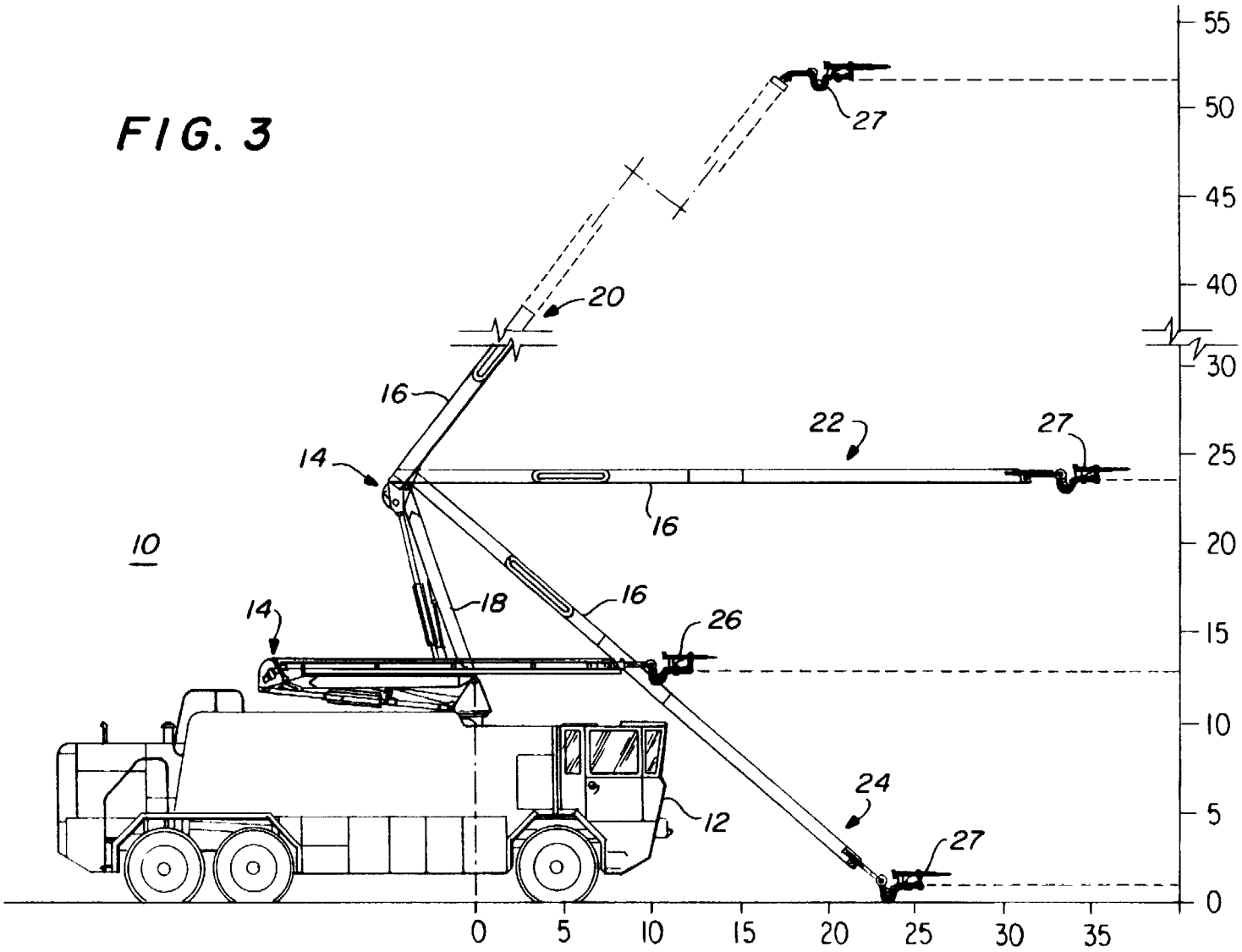
FIG. 3 is a schematic representation of the present invention maintaining the horizontal position of the fluid nozzle in any vertical position of the boom.

During a roll-in approach to the fire when the operators are very busy attempting to control the vehicle positioning, operating radios, operating pump controls, and the like, all necessary during the crucial early stages of fire fighting, it is difficult to be able to operate controls 28 and 32 at the same time. It would be advantageous if, as shown in FIG. 3, the fluid nozzle 27 would remain in a horizontal position in any vertical position of the upper boom 16 as illustrated at positions 20, 22, and 24 in FIG. 3. Further, on approaches to the fire when the boom system 14 is nested on top of the truck as illustrated in FIG. 3, the nozzle 27 would still maintain its horizontal position to spray the fire retardant on the fire. This is done automatically with the present invention as will be shown hereafter thus requiring the operator to move only one joystick to control the position of the boom 16 in the vertical plane in any desired position. During that time the fluid nozzle 27 will remain in a horizontal position automatically as illustrated.

This is accomplished with the circuit shown in diagrammatic form in FIG. 4. Again, a controlling device 32, such as a joystick, may generate signals for use by a control circuit 34 in a well-known manner to drive a motor 17 and move the boom 16 upwardly or downwardly. Also, a second control device 28, such as an operator-controlled joystick, is coupled to a control circuit 36 for driving a motor 26 to control the nozzle 27 in the vertical plane. When switch 40, coupled to control circuit 36, is in a first position, the signals from the joystick 28 provide manual control of the nozzle 27 in the vertical plane. However, when switch 40 is in a second position, an automatic levelling device 38 mounted to the nozzle assembly 27 and sensing the position of the nozzle 27 with respect to the horizontal, generates output signals to the control circuit 36 that drive motor 26 to cause the nozzle 27 to maintain a horizontal position. The circuitry is shown in detail in FIG. 5.

As can be seen in FIG. 5, when joystick 32 generates an output signal on line 42, it is coupled to a relay 44 in control circuit 34. Relay 44 becomes energized thus causing contact 46 to move from ground potential to the proper voltage on terminal 48. This voltage is coupled through switch contact 46 on line 50 to the boom motor 17, then out through conductor 52 and through relay contact 54 to ground thus causing the boom to move upwardly. When the joystick 32 produces an output signal on line 56, relay 58 is energized in control circuit 34 causing relay contact 54 to move from ground potential to terminal 60 wherein the proper voltage thereon is coupled through line 52 in the reverse direction through boom motor 17 out on line 50 and through relay contact 46 to ground potential. Thus the motor 17 moves the boom 16 in the reverse direction.

For manually controlling the vertical position of the nozzle 27, joystick 28 provides output signals on either line 62 or 78. If the signal is on line 62, it is coupled through relay contact 64 in control unit 36 to energize relay 66. This causes contact 68 to move from ground to the voltage terminal 70 having voltage applied thereto. That voltage is coupled through contact 68 on line 72 through the nozzle motor 26 and out on line 74 through relay contact 76 to ground potential. Thus the nozzle motor 26 moves the fluid nozzle 27 in the vertical plane in one direction. When the joystick 28 produces a signal on line 78, it passes through relay contact 80 on line 98 to energize relay 82. This causes contact 76 to move from ground potential to the voltage receiving terminal 70. This voltage is coupled on line 74 through the nozzle motor 26 in the reverse direction and out on line 72 through relay contact 68 to ground potential. Thus the nozzle motor 26 moves the fluid nozzle 27 in the reverse direction.

A level sensor and platform 38 is shown as being associated with nozzle motor 26 as represented by phantom line 39 so that it senses the position of fluid nozzle 27 in the vertical plane. Level sensor 38 may be of a type that is commercially marketed under the designation of automatic platform leveler Model 410 and sold by P-Q Controls, Inc. It can sense the degree and direction of an out-of-level condition, provide an output signal which will actuate a valve or motor, and re-level the platform. It can be used with both electric and hydraulic actuators. It generates output signals on lines 94 and 96 to indicate when the nozzle 27 and motor 26 are above or below the horizontal. When switch 40 is actuated, the voltage supply 84 is coupled on line 86 to relay 88. Relay 88 opens contacts 64 and 80 that couple the joystick 28 to the control unit 36 thus disabling the output from joystick 28. However, it also closes relay contacts 90 and 92 which couple the output of level platform 38 on lines 94 and 96 to lines 98 and 100. Thus the level platform 38 then controls the nozzle motor to maintain the fluid nozzle in the horizontal position. In this case, when the fluid nozzle 27 is below the horizontal, a signal is generated by the level sensor 38 on line 94 which passes through closed relay contact 90 to energize relay 66. This closes spring-loaded contact 68 with voltage source 70 and generates the signal on line 72 through the nozzle motor 26 in one direction and out on line 74 through relay contact 76 to ground thus driving the nozzle motor 26 to move the fluid nozzle 27 upwardly until the horizontal position is reached and the signal on line 94 is removed. At that time, the relay 66 is de-energized and the contact 68 goes back to ground thus stopping the movement of the fluid nozzle 27.

On the other hand, if the level platform 38 senses that the platform is above horizontal, it generates a signal on line 96 which passes through relay contact 92 to line 98 to energize relay 82. As explained earlier, relay contact 76 moves from ground potential to the voltage supply 70 which is coupled on line 74 through the nozzle motor 26 in the reverse direction and out on line 72 through relay contact 68 to ground. Thus the nozzle motor 26 is driven to move the fluid nozzle 27 downwardly until it reaches the horizontal at which time the signal is removed from line 96 and relay 82 is de-energized thus releasing spring-loaded contact 76 back to ground and stopping movement of nozzle motor 26.

Thus with switch 40 in a first position, manual control of the fluid nozzle 27 in the vertical plane is enabled and, when it is in the second position, the joystick 28 for manual control is disabled and the automatic level sensor 38 generates the signals to control the position of the fluid nozzle in the horizontal plane.

As stated earlier, as the vehicle approaches the fire, the switch 40 can be closed thus allowing the level sensor 38 to maintain the nozzle 26 in the horizontal plane for any vertical position of the boom 16 thus eliminating one control for the operator when he is the busiest. The operator need only adjust one control for the boom and that is in the vertical plane.

Figure 6:
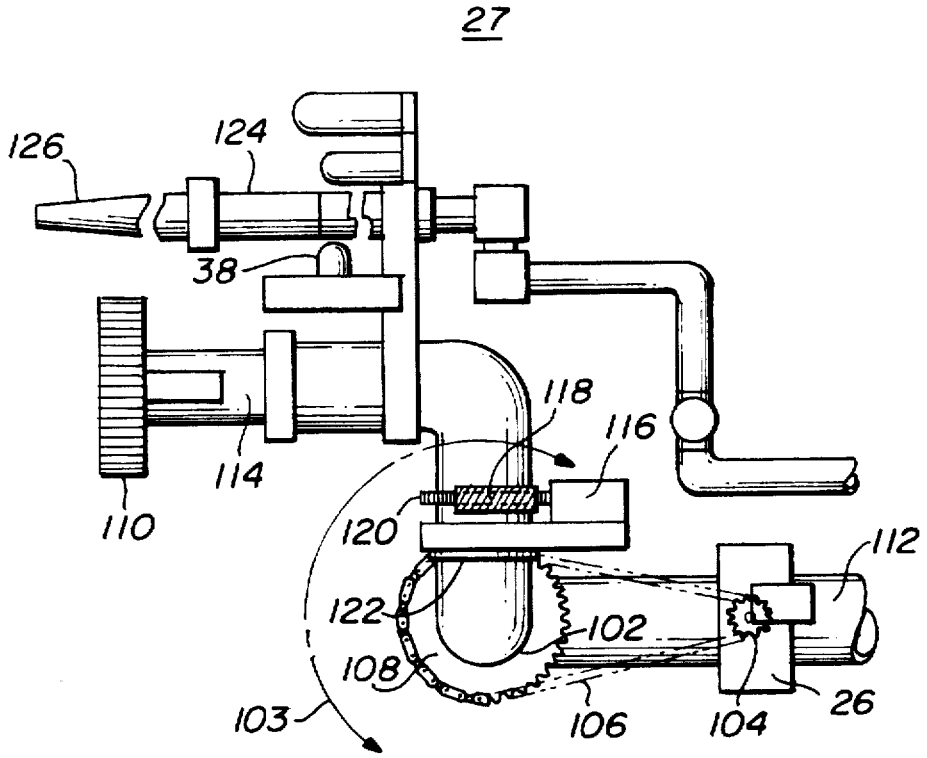
FIG. 6 is a diagrammatic representation of the fluid nozzle with the automatic levelling sensor attached thereto.

The nozzle assembly 27 is illustrated in detail in FIG. 6. It includes a fluid inlet pipe 112 that transmits fluid through outlet pipe 114 and nozzle 110. Nozzle motor 26 drives a gear 104 to which is coupled a chain drive 106. The chain drive 106 drives a gear 108 that is rigidly coupled to pipe elbow 102. This allows the entire assembly beyond gear 108 to be driven in a vertical plane as indicated by the arrow 103. The level sensor 38 is mounted at any convenient location on the fluid nozzle assembly 27 to generate the signals that control the nozzle motor 26 to maintain the nozzle assembly 27 in the horizontal as explained previously. Also shown in FIG. 6 is a motor 116 for driving a worm gear 118 engaged with gear teeth 120 to rotate the nozzle 110 in the horizontal plane about pivotal connection 122. Also shown is a piercing nozzle 126 coupled to a fluid supply 124 for penetrating a surface, all as described in U.S. Pat. No. 5,211,245.

Thus there has been disclosed a novel apparatus for automatically controlling a fluid nozzle on the outer end of a movable aerial boom on a vehicle to maintain the fluid nozzle in a horizontal plane irrespective of the position of the boom in the vertical plane. An automatic levelling sensor and a manually operated joystick control are both coupled through a control unit to the drive motor for movement of the fluid nozzle in the vertical plane. A switch having first and second positions enables either the joystick or the automatic levelling sensor to control the position of the fluid nozzle in the vertical plane.

While the invention has been described in connection with a preferred embodiment, it is not intended to limit the scope of the invention to the particular form set forth, but, on the contrary, it is intended to cover such alternatives, modifications, and equivalents as may be included within the spirit and scope of the invention as defined by the appended claims.

I claim:

1. In an aerial lift for a vehicle of the type having a fluid nozzle positionable by a drive mechanism in a vertical plane on the outer end of a movable upper boom that faces forward on a vehicle, an improved fluid nozzle including:

a horizontal level detector movable with the fluid nozzle and generating a signal when the fluid nozzle is not positioned in the horizontal plane;

a drive mechanism coupled to the fluid nozzle for positioning the fluid nozzle in the vertical plane; and a switch for selectively coupling the horizontal level detector signal to the drive mechanism to maintain the fluid nozzle in the horizontal plane at all times irrespective of the vertical position of the upper boom.

2. Apparatus for automatically controlling a fluid nozzle on the outer end of a movable aerial boom on a vehicle to maintain the fluid nozzle in a horizontal plane, the apparatus including:

a first drive mechanism for moving the aerial boom in a vertical plane;

a second drive mechanism for moving the fluid nozzle in a vertical plane;

a first operator-controlled device coupled to said first drive mechanism for selectively moving the aerial boom in a vertical plane;

a second operator-controlled device coupled to the second drive mechanism for selectively moving the fluid nozzle in a vertical plane;

a horizontal level detector associated with movement of the fluid nozzle in the vertical plane and generating an output signal when the fluid nozzle is not positioned in the horizontal plane; and a switch for selectively disconnecting the second operator-controlled device from the second drive mechanism and simultaneously connecting the horizontal level detector output signal to the second drive mechanism to automatically keep the fluid nozzle in a horizontal plane as the aerial boom is moved in the vertical plane.

3. Apparatus for automatically maintaining a fluid nozzle in the horizontal plane when pivotally coupled to the outer end of an aerial boom that moves in a vertical plane, the apparatus including:

an automatic level sensor associated with the fluid nozzle movement in the vertical plane, the sensor generating first and second output signals representing positions of the fluid nozzle above and below the horizontal plane; and a drive mechanism coupled to the fluid nozzle and to the automatic level sensor for receiving the first and second output signals and maintaining the fluid nozzle in the horizontal plane corresponding to the received signals irrespective of the position of the aerial boom in the vertical plane.

4. Apparatus as in claim 3 further including:

an operator-controlled device for producing signals to move the fluid nozzle in the vertical plane;

a switch having first and second positions for operating a relay having first and second contacts;

the first relay contacts coupling the operator-controlled device signals to the drive mechanism to manually control movement of the fluid nozzle in the vertical plane when the switch is in its first position; and the second relay contacts coupling the automatic level sensor output signals to the drive mechanism to automatically maintain the fluid nozzle in the horizontal plane irrespective of movement of the aerial boom when the switch is in its second position.

5. Apparatus as in claim 4 further including:

an additional drive mechanism coupled to the aerial boom for moving the boom in a vertical plane; and an additional operator-controlled device for generating output signals that are coupled to the additional drive mechanism to move the aerial boom in the vertical plane such that, when the switch is in the first position, an operator can selectively and separately position both the aerial boom and the fluid nozzle in the vertical plane and, in the second switch position, can selectively position the aerial boom in the vertical plane while the fluid nozzle remains in a horizontal plane automatically irrespective of the aerial boom vertical position.

* * * * *